US005088802A

United States Patent [19]

House

[11] Patent Number: 5,088,802

[45] Date of Patent: Feb. 18, 1992

[54] DESK APPARATUS

[76] Inventor: Daniel E. House, 235 Canford Dr., Hampton, Va. 23669

[21] Appl. No.: 668,226

[22] Filed: Mar. 12, 1991

[51] Int. Cl.[5] ..... A47B 88/00

[52] U.S. Cl. ..... 312/327; 312/255; 312/231; 108/6

[58] Field of Search ..... 108/6, 50; 248/456; 312/327, 255, 231

[56] References Cited

U.S. PATENT DOCUMENTS

| | | | |
|---|---|---|---|
| 1,138,265 | 5/1915 | Vosburgh | 108/6 X |
| 2,030,348 | 2/1936 | Barrett | 108/6 X |
| 3,140,559 | 7/1964 | Grow et al. | 108/6 |
| 3,358,620 | 12/1967 | Parigi | 108/6 |
| 3,494,306 | 2/1970 | Aguilar | 108/6 |
| 4,108,046 | 8/1978 | Yindra et al. | 108/6 X |
| 4,313,589 | 2/1982 | Vega | 248/558 |

*Primary Examiner*—Joseph Falk
*Attorney, Agent, or Firm*—Leon Gilden

[57] ABSTRACT

A desk apparatus for use as a desk or easel is arranged, wherein the desk plate is mounted upon an underlying rectangular framework, including a forward pivoting of the plate and a rear telescoping leg to orient the desk plate at a predetermined angle. A forward tray is selectively and pivotally mounted relative to a forward end of the desk plate, with container drawers slidably mounted orthogonally relative to opposed side edges of the desk plate. A modification of the invention includes indicator members arranged for indication of desired orientation of each container drawer relative to the desk plate utilizing fiber optical cables selectively alignable relative to the container and desk plate.

4 Claims, 4 Drawing Sheets

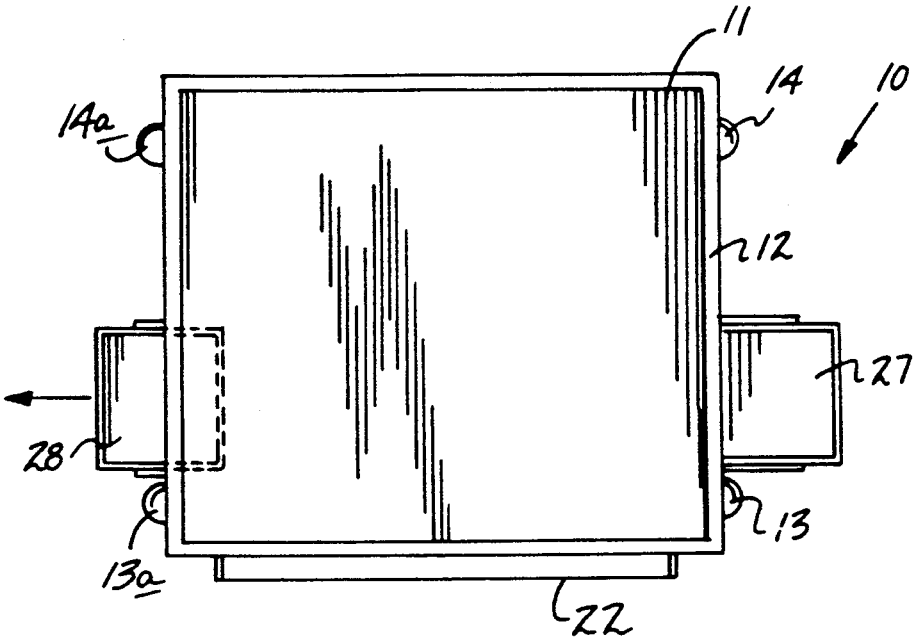
Fig 1
Fig 2
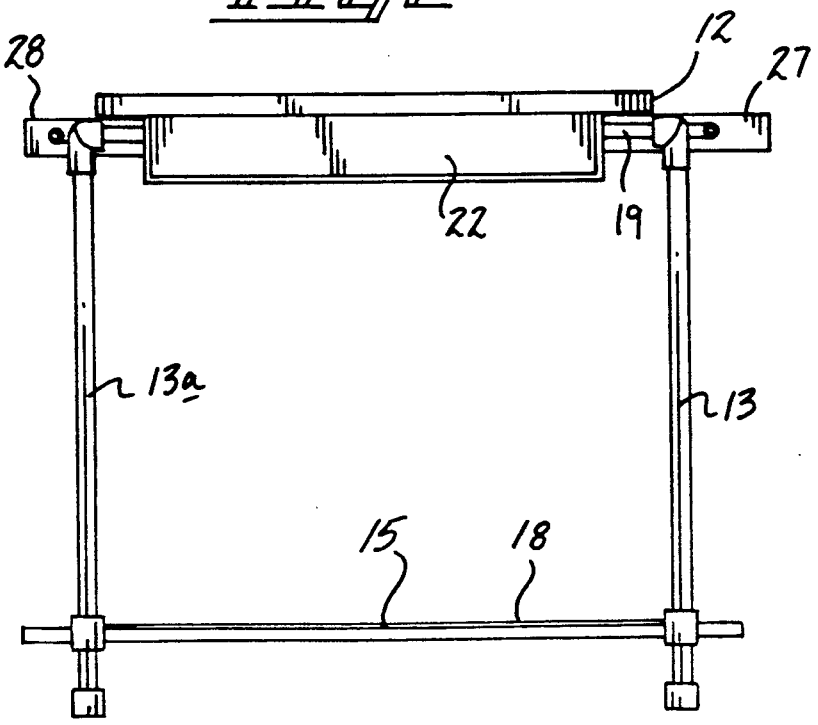

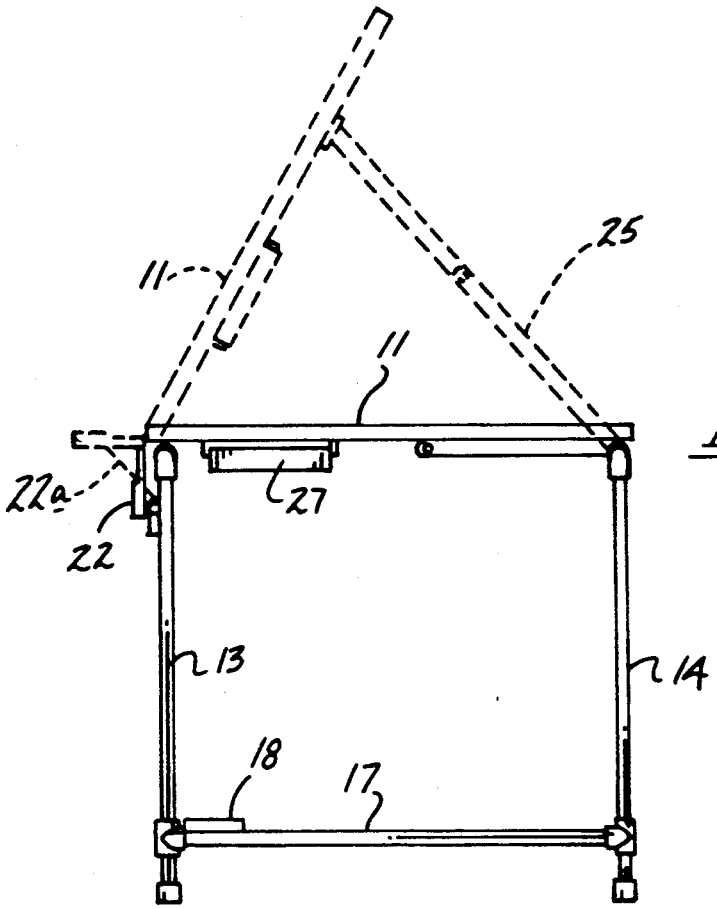
Fig 5
Fig 6
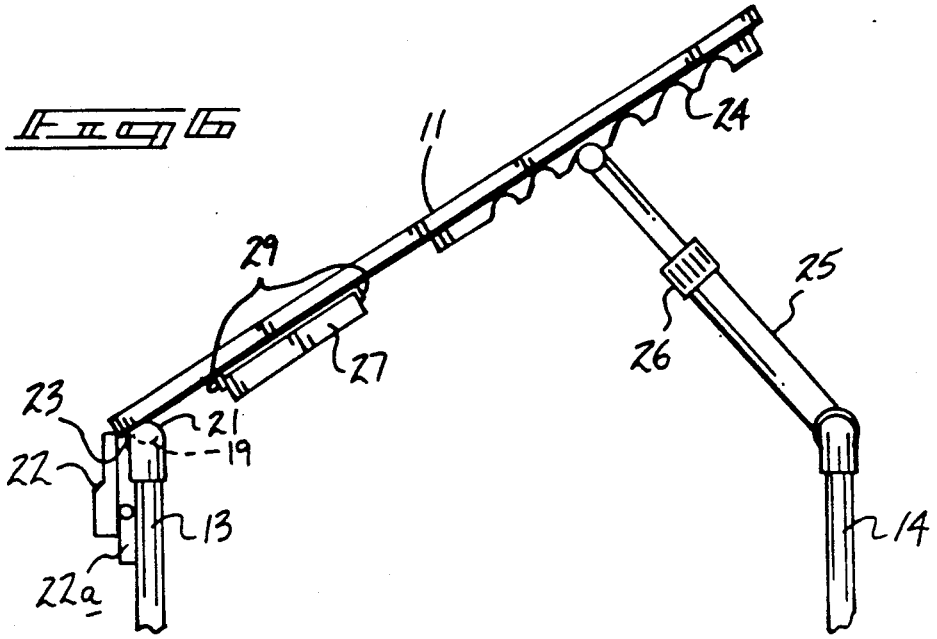

DESK APPARATUS

BACKGROUND OF THE INVENTION

1. Field of the Invention

The field of invention relates to desk apparatus, and more particularly pertains to a new and improved desk apparatus wherein the same is arranged for use as a desk or easel.

2. Description of the Prior Art

Desk structure of various types have been utilized in the prior art. Desk structure is selectively utilized for proper mounting of a desk plate relative to a user thereof. Examples of prior art include U.S. Pat. No. 4,313,589 to Vega wherein a reading desk formed as a transparent desk plate is fixedly mounted to upper terminal ends of support legs.

U.S. Pat. No. 3,140,559 to Grow, et al. sets forth a drafting table, wherein the table is hingedly and vertically mounted relative to an underlying support.

As such, it may be appreciated that there continues to be a need for a new and improved desk apparatus as set forth by the instant invention which addresses both the problems of ease of use as well as effectiveness in construction in proper mounting and orientation of a supporting desk plate relative to a user thereof in a selective manner and in this respect, the present invention substantially fulfills this need.

SUMMARY OF THE INVENTION

In view of the foregoing disadvantages inherent in the known types of desk apparatus now present in the prior art, the present invention provides a desk apparatus wherein the same is arranged for selective angular orientation of a desk plate relative to an underlying support. As such, the general purpose of the present invention, which will be described subsequently in greater detail, is to provide a new and improved desk apparatus which has all the advantages of the prior art desk apparatus and none of the disadvantages.

To attain this, the present invention provides a desk apparatus for use as a desk or easel, wherein the desk plate is mounted upon an underlying rectangular framework, including a forward pivoting of the plate and a rear telescoping leg to orient the desk plate at a predetermined angle. A forward tray is selectively and pivotally mounted relative to a forward end of the desk plate, with container drawers slidably mounted orthogonally relative to opposed side edges of the desk plate. A modification of the invention includes indicator members arranged for indication of desired orientation of each container drawer relative to the desk plate utilizing fiber optic cables selectively alignable relative to the container and desk plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved desk apparatus which has all the advantages of the prior art desk apparatus and none of the disadvantages.

It is another object of the present invention to provide a new and improved desk apparatus which may be easily and efficiently manufactured and marketed.

It is a further object of the present invention to provide a new and improved desk apparatus which is of a durable and reliable construction.

An even further object of the present invention is to provide a new and improved desk apparatus which is susceptible of a low cost of manufacture with regard to both materials and labor, and which accordingly is then susceptible of low prices of sale to the consuming public, thereby making such desk apparatus economically available to the buying public.

Still yet another object of the present invention is to provide a new and improved desk apparatus which provides in the apparatuses and methods of the prior art some of the advantages thereof, while simultaneously overcoming some of the disadvantages normally associated therewith.

Still another object of the present invention is to provide a new and improved desk apparatus wherein the same is arranged for selective and desired orientation of a desk plate relative to an underlying support, as well as providing indicator means for indicating proper alignment of sliding drawer structure relative to the desk plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top orthographic view of the instant invention.

FIG. 2 is an orthographic frontal view, taken in elevation, of the instant invention.

FIG. 5 is an orthographic side view of the instant invention.

FIG. 6 is an enlarged orthographic side view of the desk plate apparatus of the instant invention.

DESCRIPTION OF THE PREFERRED EMBODIMENT

Figure 3:
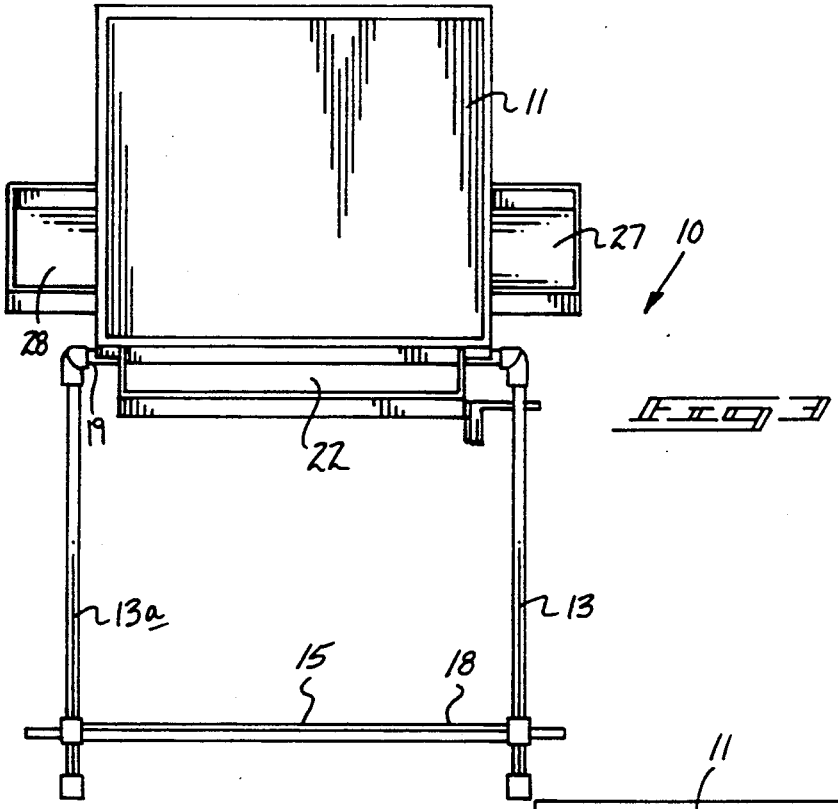
FIG. 3 is an orthographic frontal view, taken in elevation, of the desk plate in a raised orientation.

With reference now to the drawings, and in particular to FIGS. 1 to 8 thereof, a new and improved desk apparatus embodying the principles and concepts of the present invention and generally designated by the reference numerals 10 and 10*a* will be described.

Figure 4:
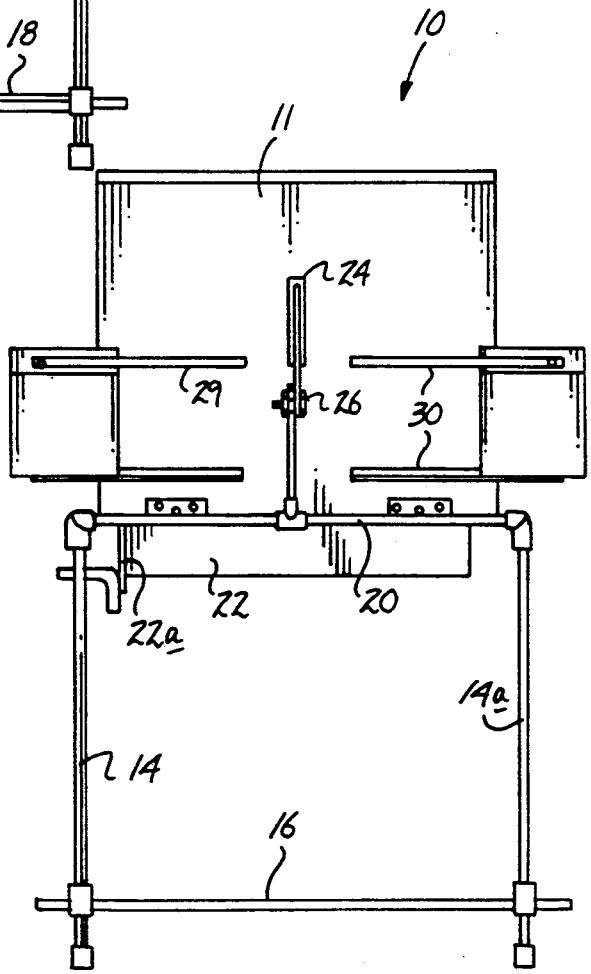
FIG. 4 is an orthographic rear view, taken in elevation, of the desk plate in a raised orientation.

More specifically, the desk apparatus 10 of the instant invention essentially comprises a desk plate 11, with the desk plate 11 including a perimeter frame 12 mounted continuously thereabout. A plurality of forward support legs includes a right and left forward support leg 13 and 13*a* respectively, with a plurality of rear support legs defined by a respective right and left rear support leg 14 and 14*a*. The support legs define a generally square configuration and include a forward support bar 15 and a rear support bar 16 directed fixedly and orthogonally between the respective forward and rear support legs adjacent their lower terminal ends. Side support bar 17 extends orthogonally between respective right forward and rear support legs and respective left rear end support legs, as illustrated in FIG. 5 for example. A foot rest plate 18 is fixedly mounted to the side support bars 17 and extends coextensively between the right and left forward support bars and is mounted at an intersection of the right and left forward support legs and the side support bars. A forward mounting bar 19 is mounted and extends orthogonally between upper terminal ends of the forward right and left support bars 13 and 13*a*, and is arranged parallel from a rear mounting bar 20 that is mounted to upper terminal ends of the right and left rear support legs 14 and 14*a*. The forward mounting bar 19 includes a forward mounting bar hinge 21 hingedly mounting the desk plate 11 adjacent its forward terminal edge about the forward mounting bar 19. A tray plate 22, including a tray plate hinge 23 and tray plate linkage 22*a*, is hingedly mounted to the forward edge of the perimeter frame 12, in a manner as illustrated in FIG. 6 for example, and extends to a raised orientation orthogonally oriented relative to the right and left forward support legs 13 and 13*a*. A multi-toothed rack 24 is mounted medially to a rear surface of the desk plate 11 and is directed orthogonally relative to the rear mounting bar 20, wherein the rear mounting bar 20 pivotally and medially of its length mounts a telescoping support leg 25. The telescoping support leg 25 includes a first leg telescopingly receiving a second leg, including a friction clamp 26 mounted to an upper terminal end of the first leg to telescopingly secure the second leg in a fixed orientation, wherein the second leg is mounted within a multi-toothed rack 24 to provide selective angulation of the desk plate 11. If desired, the telescoping leg 25 is removed relative to the desk plate 11 to permit the desk plate 11 to extend in a parallel relationship relative to the forward and rear mounting bars 19 and 20, in a manner as illustrated in FIG. 5 for example. A respective right and left container drawer 27 and 28 is slidably mounted to a bottom surface of the desk plate 11, wherein the right and left container drawer 27 extend reciprocatably and orthogonally relative to opposed sides of the desk support plate 11, wherein the right and left container drawers 27 and 28 are aligned relative to one another and are slidably mounted within respective right and left guide flange pairs 29 and 30, in a manner as illustrated in FIG. 4.

Figure 7:
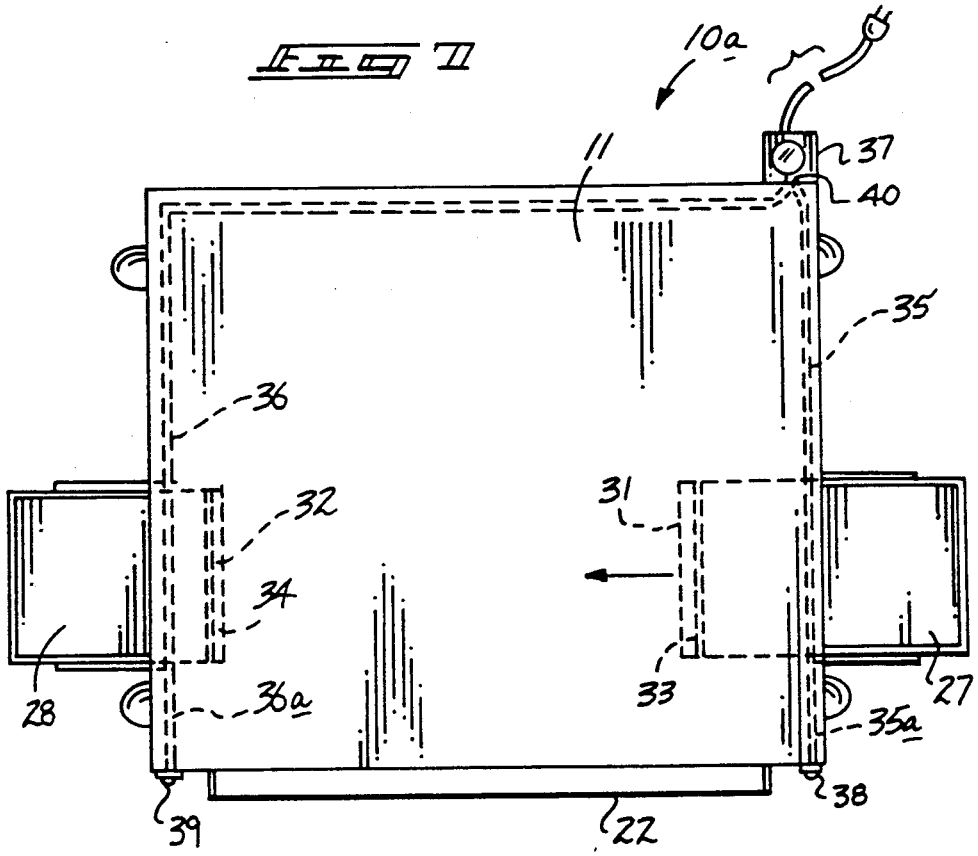
FIG. 7 is an orthographic top view of a modified desk plate structure utilized by the instant invention.
Figure 8:
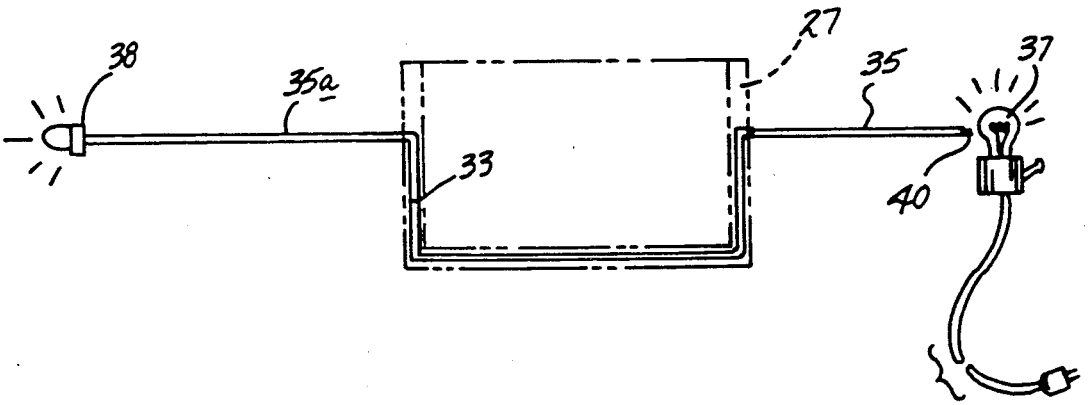
FIG. 8 is an orthographic cross-sectional illustration of a fiber optic circuit utilized by the instant invention.

To provide indication of extension and orientation of the container drawers, a respective right and left container fiber optic cable 33 and 34 are coextensively mounted and received within the right and left containers respective right and left container rear wall 31 and 32, as illustrated in FIG. 7. Reference to FIG. 8 illustrates the orientation of each fiber optic cable, wherein illumination source 37 is mounted to a rear edge of the desk plate 11, wherein a fiber optic cable junction 40 is positioned in proximate communication with the illumination source 37. A right fiber optic cable rear branch 35 extends longitudinally along a right side edge of the desk plate 11 to a position adjacent the right container fiber optic cable 33 when the container drawer is in an extended orientation and when in the extended orientation, the right container fiber optic cable 33 and the left fiber optic cable 34 are in alignment with the respective right fiber optic cable rear branch 35 and the left fiber optic cable rear branch 36. A right fiber optic cable forward branch 35*a* extends from a forward terminal end of the right container fiber optic cable 33 to a forward right edge of the desk plate, and wherein the left container fiber optic cable 34 is in contiguous communication with a left fiber optic cable forward branch 37 that extends to a left forward edge of the desk plate 11. A respective right and left indicator light 38 and 39 positioned exteriorly of the desk plates forward edge indicate alignment of the fiber optic cables and proper positioning of the drawers in an extended orientation for their safe and effective use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A desk apparatus comprising, in combination, a desk plate, the desk plate including a forward edge, a rear edge, a right side edge, and a left side edge defining a rectangular configuration, and a right forward support leg and a left forward support leg, and a right rear support leg and a left rear support leg, the support legs arranged parallel relative to one another, and a right side bar orthogonally and fixedly mounted between the right forward support leg and the right rear support leg, and a left side bar mounted between the left forward support leg and the left rear support leg, wherein the side bars are arranged parallel relative to one another, and a foot rest plate mounted fixedly overlying the side bars adjacent the right forward support leg and the left forward support leg, and a forward mounting bar orthogonally and fixedly mounted between upper terminal ends of the respective right forward support leg and left forward support leg, and a desk hinge, the desk hinge mounted to the bottom surface of the desk plate, and the desk hinge hingedly mounting the desk plate to the forward mounting bar, with the forward mounting bar positioned adjacent the forward edge of the desk plate, and a rear mounting bar orthogonally mounted to upper terminal ends of the right rear support leg and the left rear support leg, with the rear mounting bar arranged parallel to the forward mounting bar, and the rear mounting bar including a telescoping support leg medially and pivotally mounted to the rear mounting bar, with the telescoping leg including a first leg telescopingly receiving a second leg, and the first leg including a friction clamp to selectively secure the second leg within the first leg at preselected positions, and a multi-toothed rack fixedly and medially mounted to the rear surface of the desk plate receiving an upper terminal end of the second leg selectively therewithin.

2. An apparatus as set forth in claim 1 including a tray plate hingedly mounted to the forward edge of the desk plate, and including tray plate linkage to maintain the tray plate in a raised position in alignment with the forward mounting bar and the rear mounting bar.

3. An apparatus as set forth in claim 2 including an illumination source fixedly mounted to the desk plate to the rear edge thereof, and a fiber optic junction positioned adjacent the illumination source, the fiber optic junction including a right fiber optic cable rear branch extending from the cable junction along the desk plate rear edge, and a container drawer slidably mounted to the bottom surface of the desk plate, the container drawer including a container drawer rear wall, the container drawer rear wall including a right container fiber optic cable and the container drawer right fiber optic cable slidably positioned in alignment with the right fiber optic cable rear branch, and a right fiber optic cable forward branch extending from the right container rear wall and including a right indicator light mounted to the forward edge of the desk plate, whereupon alignment of the right container fiber optic cable with the right fiber optic cable rear branch and the right fiber optic cable forward branch effects illumination of the right indicator light.

4. An apparatus as set forth in claim 3 including a left container drawer slidably mounted to the bottom surface of the desk apparatus reciprocatably mounted relative to the left edge of the desk plate, and the left container including a left container rear wall fiber optic cable mounted therewithin, and the fiber optic cable junction including a left fiber optic cable extending from the fiber optic cable junction along the left side edge of the desk plate, whereupon the left fiber optic cable rear branch is selectively aligned with the left container fiber optic cable and further including a left fiber optic cable forward branch extending from the left container forwardly to the forward edge of the desk plate, and the left forward edge of the desk plate including a left indicator light cooperative with the left fiber optic cable forward branch for selective illumination of the left indicator light upon alignment of the left container rear wall fiber optic cable, the left fiber optic cable forward branch and the left fiber optic cable rear branch.

* * * * *